US011052569B2

(12) United States Patent
Cueto

(10) Patent No.: US 11,052,569 B2
(45) Date of Patent: Jul. 6, 2021

(54) MOLD SYSTEM FOR A MODULAR TELESCOPING BARRIER AND METHOD OF CONSTRUCTION

(71) Applicant: Jorge Cueto, Amherst, NY (US)

(72) Inventor: Jorge Cueto, Amherst, NY (US)

( * ) Notice: Subject to any disclaimer, the term of this patent is extended or adjusted under 35 U.S.C. 154(b) by 0 days.

(21) Appl. No.: 16/889,450

(22) Filed: Jun. 1, 2020

(65) Prior Publication Data

US 2020/0376709 A1 Dec. 3, 2020

Related U.S. Application Data

(60) Provisional application No. 62/854,576, filed on May 30, 2019.

(51) Int. Cl.
*B28B 7/02* (2006.01)
*E02B 3/10* (2006.01)

(52) U.S. Cl.
CPC ..... *B28B 7/02* (2013.01); *E02B 3/102* (2013.01)

(58) Field of Classification Search
CPC .. B28B 7/02; B28B 7/025; B28B 7/26; B28B 7/0029; E02B 3/12
See application file for complete search history.

(56) References Cited

U.S. PATENT DOCUMENTS 799,493 A * 9/1905 Pfeiffer ..... B28B 7/02 249/158
799,754 A * 9/1905 Petrie ..... B28B 7/0029 249/104
1,541,244 A * 6/1925 Whitfield ..... B28B 7/0029 249/82
1,756,473 A * 4/1930 Rauber ..... B28B 7/0029 249/165
3,555,748 A * 1/1971 Herman ..... E04B 1/34305 52/67
4,104,837 A 8/1978 Naito
4,307,867 A * 12/1981 Shannon ..... C04B 28/14 106/38.3
5,167,842 A * 12/1992 Vercelletto ..... B28B 7/02 249/129
6,709,201 B2 3/2004 Race
6,712,546 B1 * 3/2004 Radu, Jr. ..... B28B 7/0014 404/8

(Continued)

*Primary Examiner* — Benjamin F Fiorello
(74) *Attorney, Agent, or Firm* — Vincent G. LoTempio

(57) ABSTRACT

A mold system for a modular telescoping barrier and method of construction provides barriers arranged in a telescoping configuration with tight tolerances. The barriers are constructed with an inner and outer mold subassembly, separated by a gap. A shape-adapted funnel pours mold filling into gap between mold subassemblies. When mold filling dries, the mold subassemblies are removed to access a barrier. Barriers are nested with other barriers having incrementally larger or smaller perimeters to achieve telescoping configuration. A base barrier with a support flange supports multiple barriers. The inner and outer subassemblies are made up of individual panels fitted together end to end, and at corners in a tight relationship. Reinforcing structures abut the panels to prevent panels from bulging. The narrow end of the funnels includes clamps that press inwardly on the panels to prevent bulging. A level and an agitating mechanism enable mold filling to be poured uniformly.

20 Claims, 10 Drawing Sheets

(56) References Cited

U.S. PATENT DOCUMENTS

| | | | | |
|---|---|---|---|---|
| 6,997,427 | B2 * | 2/2006 | Manthei | B28B 7/0044 249/166 |
| 8,662,790 | B2 | 3/2014 | Phelps | |
| 9,028,175 | B2 | 5/2015 | Friederichs et al. | |
| 9,194,096 | B2 * | 11/2015 | Fergeson | B28B 1/087 |
| 9,731,433 | B1 * | 8/2017 | Shumaker | B28B 7/0014 |
| 10,538,908 | B1 * | 1/2020 | Wilson | E04B 1/34305 |
| 2005/0053429 | A1 | 3/2005 | Davidsaver et al. | |
| 2009/0148242 | A1 * | 6/2009 | Collet | B28B 7/0029 405/286 |
| 2013/0239490 | A1 * | 9/2013 | Peng | F16M 11/28 52/111 |
| 2016/0199998 | A1 * | 7/2016 | Daul | E04G 13/00 249/2 |
| 2017/0138038 | A1 * | 5/2017 | Cueto | E02B 3/102 |
| 2017/0356149 | A1 * | 12/2017 | Adler | E02B 3/102 |
| 2018/0169897 | A1 * | 6/2018 | Jennings | B28B 7/0088 |

* cited by examiner

MOLD SYSTEM FOR A MODULAR TELESCOPING BARRIER AND METHOD OF CONSTRUCTION

CROSS REFERENCE OF RELATED APPLICATIONS

This application claims the benefits of U.S. provisional application No. 62/854,576, filed May 30, 2019 and entitled MODULAR MOLD ASSEMBLY FOR TELESCOPING HOLLOW STRUCTURES AND METHOD OF CONSTRUCTING TELESCOPING HOLLOW STRUCTURES, which provisional application is incorporated by reference herein in its entirety.

FIELD OF THE INVENTION

The present invention relates generally to a mold system for a modular telescoping barrier and method of construction. More so, the present invention relates to a telescoping barrier system that provides a unique method of constructing multiple barriers arranged in a telescoping configuration to form a barrier subsystem with tight tolerances and specifications; whereby the barriers are constructed by pouring a mold filling into a gap between an inner mold subassembly and an outer mold subassembly through use of multiple shape-adapted funnels; whereby the inner and outer subassemblies are made up of individual panels fitted together end to end, and at the corners at a tight tolerance to create water-tight barriers; and whereby stability and tight tolerance is possible because of: reinforcing structures that abut the panels when mold filling is poured between inner and outer mold subassemblies, clamps on the narrow end of the funnels to prevent outward bulging of the panels, elastic members between the lateral edges of the panels, and levels and agitating mechanisms to create more precise and uniform filling between the mold subassemblies; and whereby the formed barriers are telescopically arranged, so as to expand for operation and retract for stowage, as needed.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, flooding involves an overflow of a large surplus of water beyond its normal limits, especially over what is dry land. Flooding can occur when run off surface water from sustained and heavy rain, or overspill from streams or rivers, overwhelms water drainage, removal systems and flood containment plains. In some areas flooding is compounded by incoming high tides backing up the river water and occurring in sequence with higher raised levels of body of water, such as lakes, rivers, reservoirs, and the like. This causes overspill onto the surrounding land.

Generally, a flood barrier is a type of flood gate configured to help prevent a tidal wave, storm surge, or spring tide from flooding a protected region behind the barrier. Flood barriers work to divert the surge of water to a different region from the protected region. Flood barriers can be permanent, or mobile, so as to be deployed when needed. There are different types of flood barriers including those which prevent localized flooding and prevent ingress of water into premises, and diversion barriers which direct water away from premises, habitation, or restrict tidal flow. The majority of diversion barriers are permanent solid-state wall barriers constructed from stone or brick etc. In some cases, earth mounds can be formed on riverbanks to divert water away from premises and habitation. In some instances, dumping solid-state material to raise land levels can also be used to form sea barriers.

It is known that telescoping is the movement of a module, such as one module sliding out from another, works to lengthen the module assembly from its rest state. Telescopic modules are designed with a series of barriers of progressively smaller diameters nested within each other. The largest diameter barrier is called the main or barrel. The smaller inner sleeves are called the stages. Expanding a telescoping barrier to a deployed position can be useful for when a flood occurs. Often, the formed barriers are not adaptable to stack onto one another, but operate independently. When joined to make a larger barrier system, the formed barriers do not always fit together in a harmonious, sealed relationship.

Barriers are often cast in molds. The molds serve to cast barriers as a series of discrete sections that are filled with a mold filling, and then transported to their operational location, such as a sea coast or a highway construction site for placement and assembly. In many instances, molds incorporate removable or adjustable faces to alter the cross-sectional shape or size of the mold cavity. Such precast molding has the advantage of economies of scale in being able to produce a large number of standardized barrier sections at a central facility. However, the barrier sections must then be transported to the construction site and assembled.

Other proposals have involved barrier systems that restrict forces and water. The problem with these barrier systems is that they do not have a high tolerance to create optimal water-tightness. Also, the barriers do not telescopically expand to a deployed position from a collapsed position. Even though the above cited barrier systems meet some of the needs of the market, a mold system for a modular telescoping barrier and method of construction that provides a unique method of constructing multiple barriers arranged in a telescoping configuration to form a barrier subsystem with tight tolerances and specifications, is still desired.

SUMMARY

Illustrative embodiments of the disclosure are generally directed to a mold system for a modular telescoping barrier and method of construction. The modular telescoping barrier system provides a unique method of constructing multiple barriers arranged in a telescoping configuration to form a barrier subsystem with tight tolerances and specifications. The barriers are constructed by pouring a mold filling between an inner mold subassembly and an outer mold subassembly. Both subassemblies are made up of individual panels fitted together end to end and at the corners at a tight tolerance. In one embodiment, multiple elongated panels and corner panels seamlessly connect to form a barrier under tight geometric specifications. This serves to prevent deformations, leakages, and other imperfections in the finished barrier.

The panels are fitted at a tight tolerance at the lateral edges. One of the lateral edges forms a recess, such that alternating lateral edges couple together. The secure coupling may be helped through use of guiding panels that guide vertical panels and corner panels into a tight fit, so as to achieve the exact shape desired. Furthermore, reinforcing structures maintain the panels of the inner and outer mold subassemblies in a vertical orientation. Further, the lateral, bottom, and top edges of the panels may include an elastic member to achieve water-tightness therebetween, so as to prevent leakage of mold filling. The panels may also have a level and an agitator to help in pouring the mold filling in a precise manner.

Multiple shape-adapted funnels are used to pour a mold filling into the cavity between the inner and outer mold subassemblies. The funnels are configured to match the shape and dimensions of the upper ends of the panels. The funnels detachably fasten to the upper ends of the panels in a spaced apart relationship. The funnels can be longitudinal-shaped to attach to elongated panels, or L-shaped to attach to corner panels connections.

The funnels carry the mold filling into the cavity between the inner and outer mold subassemblies. The funnels comprise a wide receiving end that receives the mold filling, a sloped sidewall that carries the mold filling to a narrow discharge end, and a slot that forms at the narrow discharge end to enable passage of the mold filling. A clamp at the narrow discharge end of the funnel biases the panels of the outer mold subassembly inwardly, so as to maintain stability of the funnel and prevent lateral expansion of the panels while being occupied with the mold filling.

After a duration, the mold filling that is poured between the inner and outer mold subassemblies hardens to adopt the shape of a barrier. Multiple barriers of varying perimeters are constructed and then arranged in a telescoping configuration. The reinforcing structures maintain stability and help maintain uniform filling and stable vertical disposition between the mold subassemblies while the cavity therebetween is being occupied with the mold filling.

After the mold filling has solidified between the inner and outer mold subassemblies, the barrier is formed. In one embodiment, the barrier is rectangular-shaped with a hollow interior space. Multiple barriers of different perimeters can be formed and nested, so as to create a telescoping relationship. In one embodiment, the barriers telescopically extend to a deployed position to form a barrier subsystem that withstands inertial and the external forces. And the barrier subsystem can be retracted to a collapsed position when not in use. In one possible embodiment, barrier subsystem is arranged in a nested configuration, such that hollow individual barriers slide along a sliding mechanism in and out of an adjacent barrier. Though, the barriers do not necessarily have to be hollow.

Such a telescopic structural configuration allows the individual barriers of the barrier subsystem to be stored inside of each other and to extend during operation. One exemplary use of the telescoping barrier subsystem is one that requires a small tolerance. Such a barrier subsystem is effective as a flood control structure. For restarting flood waters, the capacity to acquire the exact specified gap between the individual barriers stored inside of each other is crucial for the correct operation of the mechanisms that provide the water seepage control.

In one aspect, a mold system for a modular telescoping barrier, comprises:

an inner mold subassembly comprising multiple inner panels defined by a pair of lateral edges, an upper edge, and a lower edge, the inner panels joined at the lateral edges;

at least one inner reinforcing structure abutting the inner panels of the inner mold subassembly, the inner reinforcing structure maintaining the inner mold subassembly in a substantially vertical orientation;

an outer mold subassembly comprising multiple outer panels defined by a pair of lateral edges, an upper edge, and a lower edge, the outer panels joined at the lateral edges, one of the pair of lateral edges defined by a recess, the outer mold subassembly disposed to surround the inner mold subassembly in a spaced-apart relationship, whereby a gap forms between the mold subassemblies;

at least one outer reinforcing structure abutting the outer panels of the outer mold subassembly, the outer reinforcing structure maintaining the outer mold subassembly in a substantially vertical orientation; and multiple funnels operable at the top edges of the panels, the funnels comprising a wide receiving end, a sloped sidewall, and a narrow discharge end forming a slot, the discharge end of the funnels comprising a clamp, the clamp being operable to press the inner and outer panels towards each other.

In another aspect, the inner and outer mold subassemblies are defined by a substantially rectangular shape.

In another aspect, the outer mold subassembly has a larger perimeter than the inner mold subassembly.

In another aspect, the inner and outer panels comprise an elongated panel defined by a linear shape, and a corner panel defined by an L-shape.

In another aspect, the panels of the inner mold subassembly comprise four inner vertical panels and two inner corner panels.

In another aspect, the panels of the outer mold subassembly comprise four outer vertical panels, and two outer corner panels.

In another aspect, the lateral and bottom edges of the panels comprise an elastic member, the elastic member operable to restrict passage of moisture between the joined panels.

In another aspect, the system further comprises at least one fastening mechanism.

In another aspect, the fastening mechanism includes at least one of the following: a flat head screw, a hatch, and a snapping pin.

In another aspect, the lateral edges of the panels are defined by a tapped hole, or a tapped blind hole, or both.

In another aspect, the clamp presses the outer mold subassembly inwardly.

In another aspect, the reinforcing structure comprises a steel beam.

In another aspect, the reinforcing structure is disposed vertically, horizontally, or diagonally.

In another aspect, the funnels are operable to pour a mold filling in the gap between the inner and outer mold subassemblies.

In another aspect, the system further comprises a barrier formed from the mold filling.

In another aspect, the system further comprises multiple barriers having different perimeter dimensions arranged in a telescoping configuration to form a barrier subsystem.

In another aspect, the lower edge of the outer panel comprises a foot mold, the foot mold being in fluid communication with the gap between the inner and outer mold subassemblies.

In another aspect, a base barrier with a support flange forms when the mold filling is poured in the gap and the foot mold.

In another aspect, the base barrier has a larger perimeter than the multiple barriers having different perimeter dimensions.

In another aspect, the multiple barriers having different perimeter dimensions nests inside the base barrier based on perimeter dimensions.

In another aspect, the system further comprises at least one level operable on the outer reinforcing structure, or the platform, or both.

In another aspect, the system further comprises an agitating mechanism operable on the outer reinforcing structure, or in an area surrounded by the inner panels, or both.

In another aspect, the system further comprises a perimeter element, the perimeter element disposed between the platform and the lower edges of the panels.

One objective of the present invention is to provide a barrier subsystem of multiple barriers arranged in a telescoping configuration, and having a tight tolerance so as to be water-tight.

A second objective is to fit, or nest, the barriers inside each other in a telescoping relationship that extends for operation and retracts when not in use.

Another objective is to fit the panels precisely enough to create a water-tight tight tolerance for the finished barrier.

Yet another objective is to provide elastic members between the panels to restrict passage of moisture.

Yet another objective is to maintain the mold assemblies in a stable, vertical disposition while the mold filling is being poured into the gap between the inner and outer mold subassemblies.

Additional objectives are to provide external mechanisms can be connected to the barriers to extend and remained extended withstanding the external forces imposed thereon.

Yet another objective is to provide shape-fitted slotted funnels to discharge a mold filling, such as a cement slur, the molds leaving minimum to no voids in the concrete resulting elements.

Additional objectives are to manufacture the barriers manufactured with geometrical precision.

Additional objectives are to manufacture the mold subassemblies, such that less internal stress forms while the molds are being disassembled.

Yet another objective is to achieve the level of detail needed for the barriers that need to be connected to the structural elements.

Additional objectives are to fabricate and assemble the barriers quickly and with readily available materials and processes.

Additional objectives are to have the mold filling flow easily into the molds by means of the slotted funnels, which are specifically created to that purpose.

Another exemplary objective is to fabricate the individual barriers with commercially available equipment.

Yet another objective is to provide an inexpensive to manufacture telescoping barrier system.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
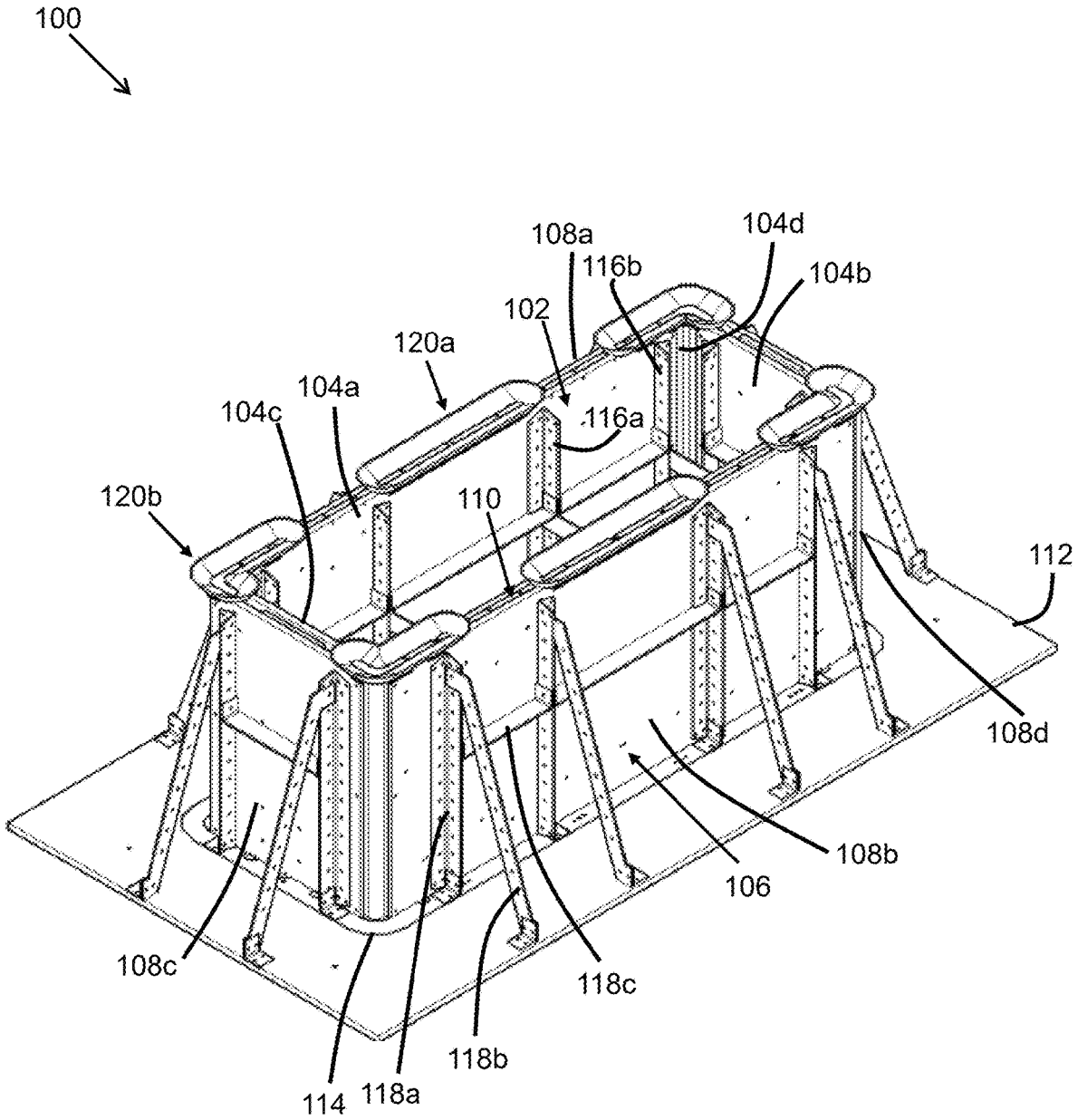
FIG. 1 illustrates a perspective view of an exemplary mold system for a modular telescoping barrier, showing an inner and outer mold subassembly for creating a barrier, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A mold system 100 for a modular telescoping barrier and method 1100 of construction is referenced in FIGS. 1-11. Mold system 100 for a modular telescoping barrier, hereafter "system 100" provides a unique method 1100 of constructing multiple barriers that can be arranged in a telescoping configuration to form a barrier subsystem 900 with tight tolerances and specifications. Barriers are constructed by setting up an inner mold subassembly 102 and an outer mold subassembly 106, separated by a gap 110. A shape-adapted funnel 120*a*, 120*b* is used to pour a mold filling into a gap 110 between the mold subassemblies 102, 106. When the mold filling dries, the mold subassemblies 102, 106 are removed to access the barrier 300, which can be nested with other barriers having incrementally larger or smaller perimeters to achieve the telescoping configuration for the barrier subsystem 900. The formed barriers include a base barrier 902 with a support flange that carries multiple other barriers in the telescopic arrangement.

To create a tight tolerance for the barriers, and thereby create a water tight barrier subsystem 900, the inner and outer subassemblies 102, 106 are made up of individual panels fitted together end to end, and at the corners in a flush, tight relationship. In another possible embodiment, the edges of the panels could be uneven, protruding to create a misalignment, or even partially not joined. Nonetheless, the tight tolerance fitting between panels serves to create water-tight barriers. The stability and tight tolerance are possible because of various unique structural components. Firstly, inner and outer reinforcing structures 118*a*, 118*b*, 118*c* abut the panels when mold filling is poured between inner and outer mold subassemblies 102, 106. Secondly, the narrow end of the funnels 120*a*, 120*b* includes clamps that press inwardly on the outer panels 108*a-d* to help prevent outward bulging of the panels. Furthermore, a level and an agitating mechanism create more precise and uniform filling between the mold subassemblies 102, 106 as the mold filling is being poured into the gap 110 between mold subassemblies 102, 106.

As referenced in FIG. 1, system 100 comprises an inner mold subassembly 102 and an outer mold subassembly 106 that work in conjunction to create a tight tolerance and precise specification mold. The molds are configured to receive a mold filling that dries to create a barrier 300. The mold subassemblies 102, 106 can have incrementally increasing perimeter sizes to form multiple barriers that can be arranged in a telescoping configuration. Barriers are extendable during operation, and retractable when not in use. Inner and outer mold subassemblies 102, 106 are made up of individual elongated panels and corner panels fitted together end to end, and at the corners in a flush, tight relationship. Various reinforcing structures and shape-adapted funnels 120*a*, 120*b* create a uniform, tight tolerance barrier 300 that is efficacious for preventing water seepage between individual barriers.

It is known in the art that problems with constructing barriers is shrinkage by the mold filling when transforming liquid-state to solid-state. If the molds are constructed from a single panel for each side (the inner side and the outer side of the mold subassemblies 102, 106), the mold subassemblies 102, 106 become trapped by the forces of mold filling during shrinkage. Thus, system 100 utilizes multiple interconnected panels to reduce the "trapping" forces due to shrinkage of the mold filling.

It is also known in the art that the mold subassemblies 102, 106 must be economical and easy to replicate, so as to facilitate transport, assemblage, and disassembling with minimal instructions. This would allow a technician to assemble and disassemble mold subassemblies 102, 106 easily. System 100 solves this problem by constructing mold subassemblies 102, 106 from multiple panels that fit together in a flush, tight relationship. Panels can also be manufactured using conventional manufacturing processes such as, CNCs machines, Waterjet Machines, Extrusion Machines, 3D printers, among others. Each of the panels that comprise the mold subassemblies 102, 106 can be manufactured with conventional means, allow the mold subassemblies 102, 106 to be fabricated in a replicable fashion. This ultimately impacts positively on the cost of the mold subassemblies 102, 106 given that the panels that comprise the mold subassemblies 102, 106 are fabricated with readily available materials and machineries.

Figure 3:
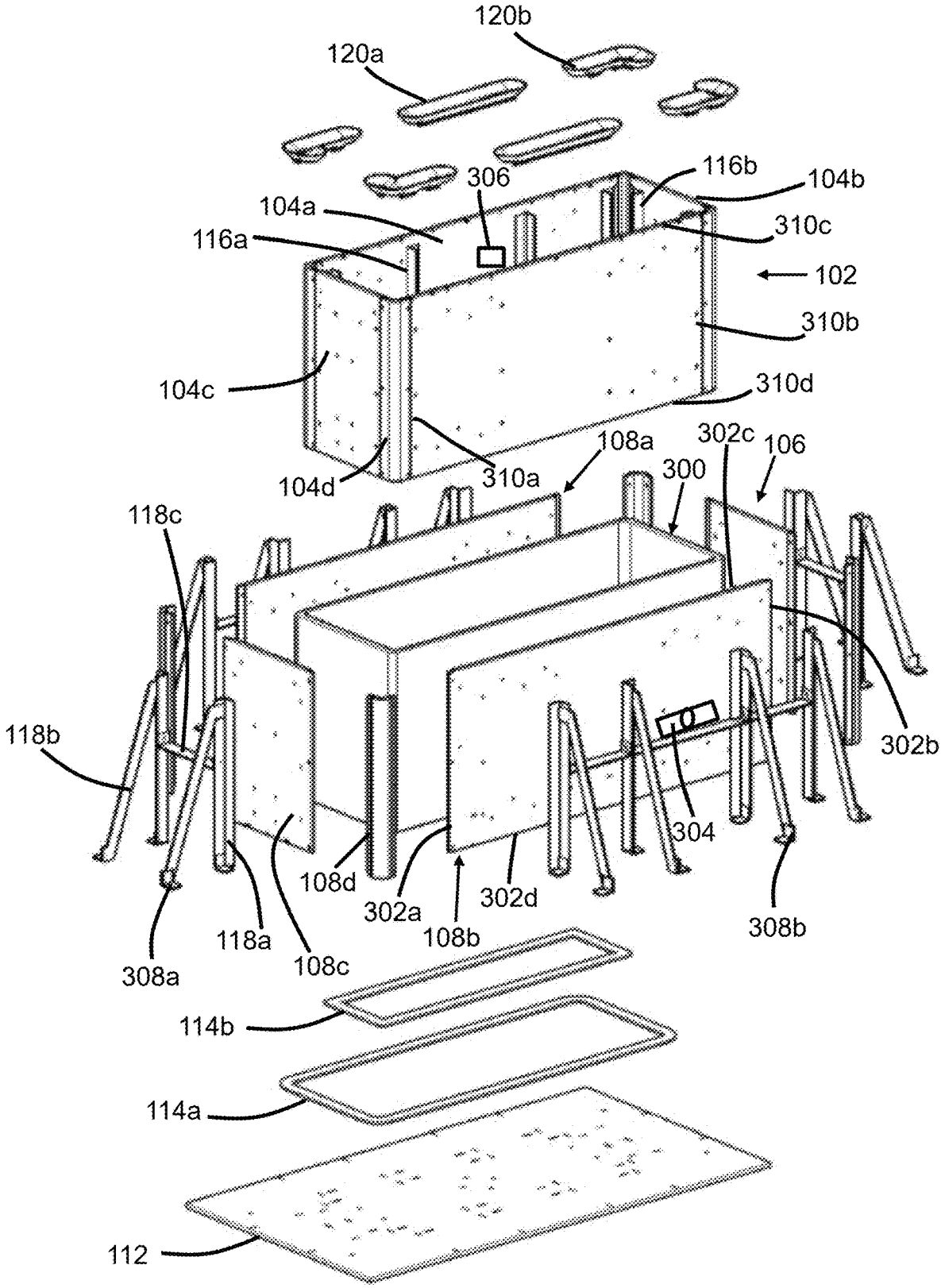
FIG. 3 illustrates a blow-up view of the modular telescoping barrier system shown in FIG. 1, in accordance with an embodiment of the present invention.

As FIG. 3 illustrates, panels are flat, rigid components that can serve as molds for the barriers. In one possible embodiment, panels include a minimum of four linear panels, and four corner panels for each of the sides of the inner and outer mold subassemblies 102, 106. Specifically, inner panels 104*a-d* of both inner and outer mold subassemblies 102, 106 comprise at least one elongated panel defined by a linear shape, and at least one corner panel defined by an L-shape. An exemplary panel arrangement can include a pair of long side panels and a pair of short end panels joined by four of corner panels. However, different numbers and sizes of inner panels 104*a-d* may be used. Inner panels 104*a-d* can allow inner mold subassembly 102 to have various shapes, including a rectangular shape, a C-shape, an L-shape, and an irregular shape. Similarly, outer panels 108*a-d* can allow outer mold subassembly 106 to have various shapes, including a rectangular shape, a C-shape, an L-shape, and an irregular shape.

Individual inner panels 104*a-d* comprise a pair of lateral edges 310*a*, 310*b*, an upper edge 310*c*, and an opposing lower edge 310*d*. Inner panels 104*a-d* fit together and securely fasten at the lateral edges. Inner panels 104*a-d* interconnect in a seamless relationship, partially due to a recess 400*a*, 400*b* that forms between at least one of the lateral edges. This type of interconnection is referenced in FIG. 4A. Recess 400*a*, 400*b* allows inner panels 104*a-d* to be fitted at a tight tolerance at the lateral edges. In one non-limiting embodiment, one of the lateral edges 310*a*, 310*b* forms a recess 400*a*, 400*b*, such that alternating lateral edges couple together. As discussed below, flat fastening mechanisms pass through tapped holes at the recess 400*a*, 400*b* cut into lateral edges 310*a-b*. This works to create a flusher fit between panels 104*a-d*, 108*a-d*.

Figure 4A:
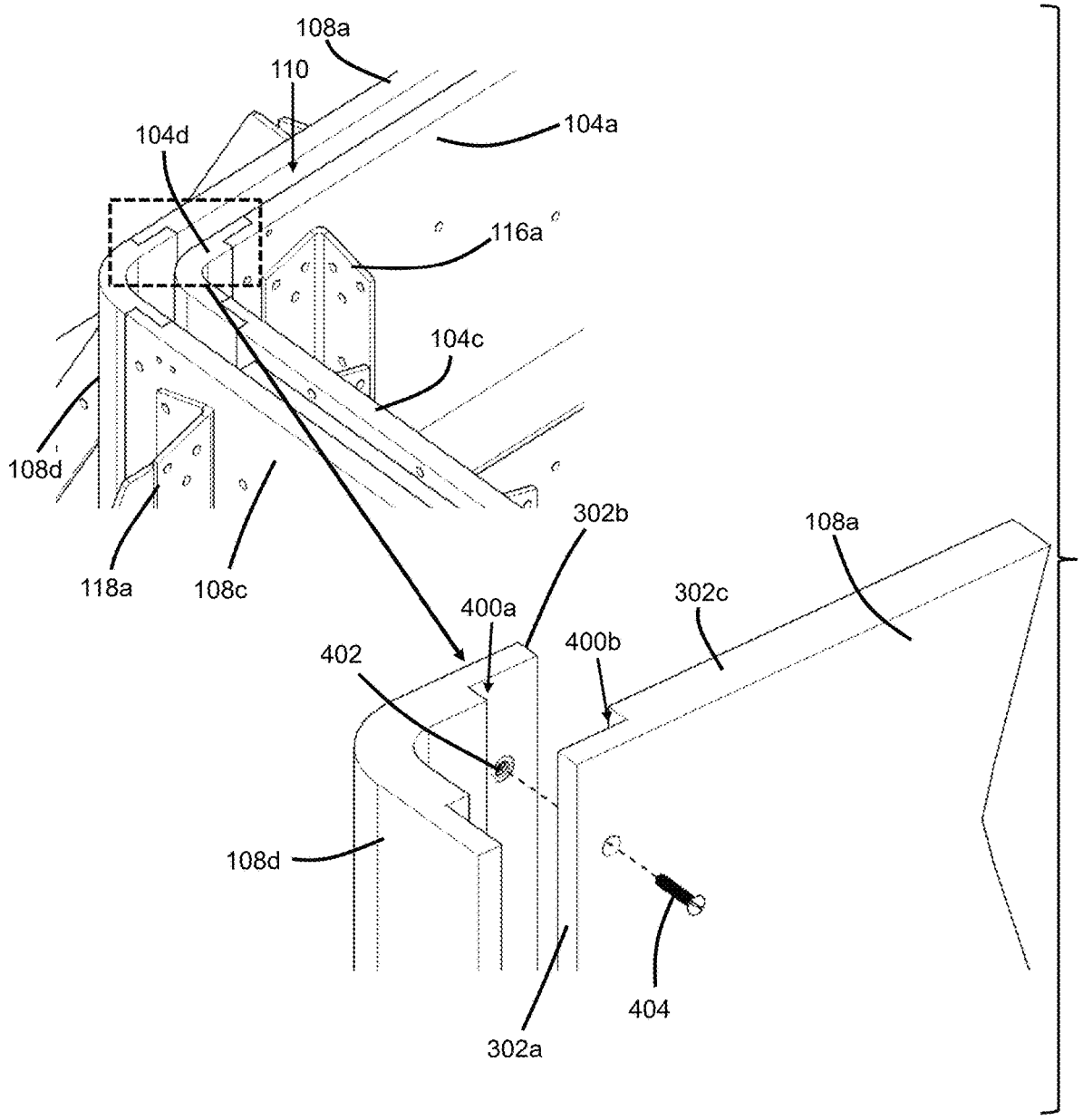
FIG. 4A illustrates a close-up view of an exemplary elongated panel and corner panel fitted together end to end at the lateral edges with a tapped hole and fastening mechanism, in accordance with an embodiment of the present invention.
Figure 4B:
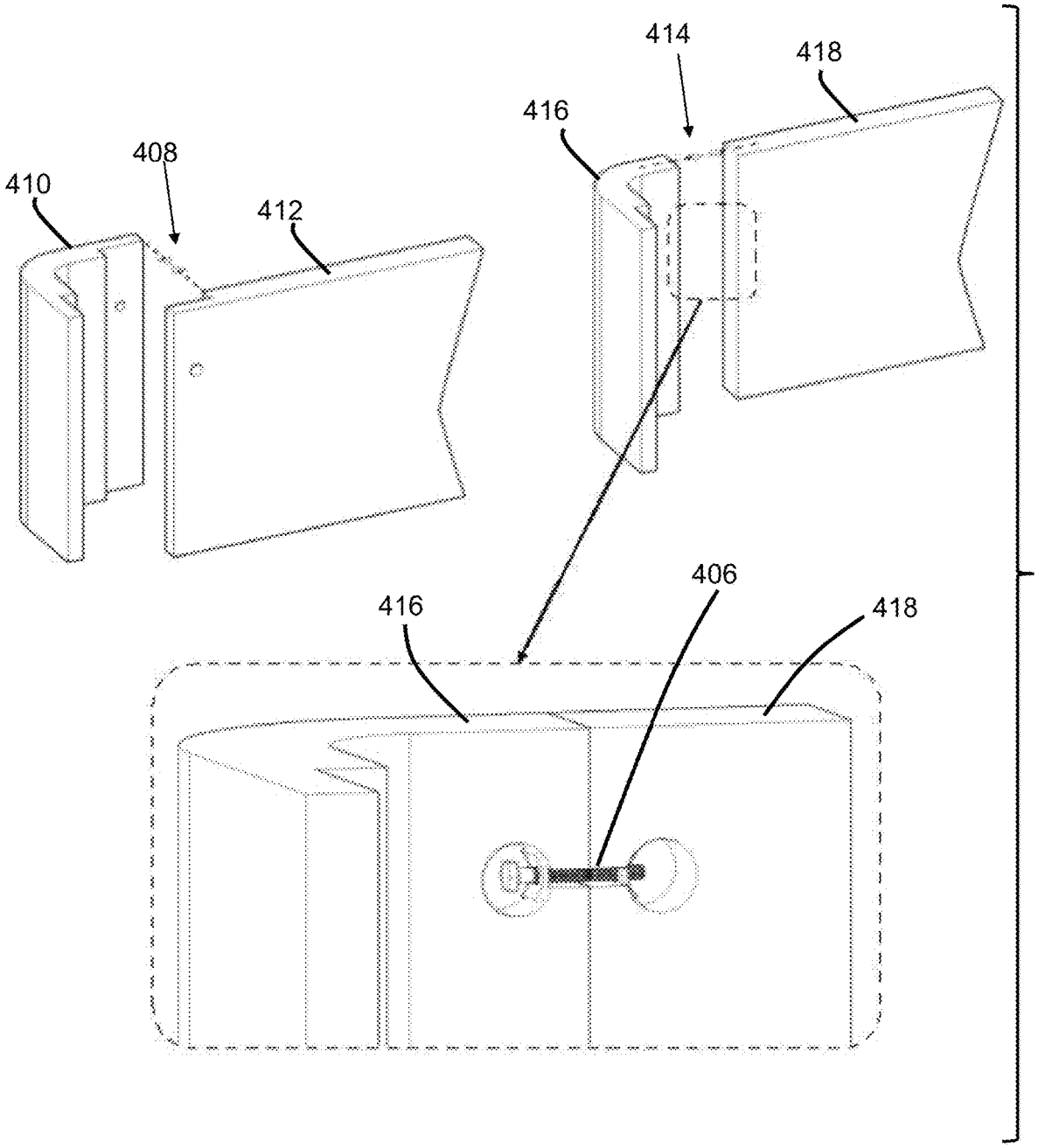
FIG. 4B illustrates a close-up view of an exemplary elongated panel and corner panel fitted together in a first interconnecting relationship with the recesses, and a second interconnecting relationship with a flush, abutting relationship, in accordance with an embodiment of the present invention.

FIG. 4B shows two additional types of panel interconnecting configurations. In a first interconnection 408, a corner panel 410 having a recess couples to a linear panel 412 having a recess. The recesses form a friction fit, snug connection. In a second interconnection 414, a corner panel 416 and a linear panel 418 with no recess abut each other to couple together in a flush relationship. In the second interconnection 414 that is illustrated, a pair of fastening holes in each adjacent panel 416, 418 provide a space to pass the elongated screw and nut 406 through. Then screw passes through the first fastening hole in the corner panel 416, and then is connected with the nut in the second fastening hole formed in the linear panel 418.

As discussed above, system 100 also includes an outer mold subassembly 106, having a larger perimeter and surrounding the inner mold subassembly 102. To surround the inner mold subassembly 102, the outer mold subassembly 106 has a larger perimeter than inner mold subassembly 102. Similar to inner mold subassembly 102, the outer mold subassembly 106 is made up of multiple outer panels 108*a-d*. Outer panels 108*a-d* are defined by a pair of lateral edges 302*a*, 302*b*, an upper edge 302*c*, and a lower edge 302*d*. Outer panels 108*a-d* are snuggly fitted and fastened at the lateral edges 302*a-b*. Similar to inner panels, outer panels 108*a-d* interconnect in a seamless relationship, partially due to a recess that forms between the interconnections at alternating lateral edges 302*a-b*. Outer panels 108*a-d* comprise at least one elongated panel 104*a*, 108*a* defined by a linear shape, and at least one corner panel 104*d*, 108*d* defined by an L-shape.

As illustrated in FIG. 1, outer mold subassembly 106 is disposed to surround inner mold subassembly 102 in a spaced-apart relationship. A gap 110 forms between the mold subassemblies 102, 106. Gap 110 is open along the length and width of mold subassemblies 102, 106, allowing mold filling to freely flow between inner and outer mold subassemblies 102, 106, and form a barrier 300. The length of gap 110 between inner and outer mold subassemblies 102, 106 is dependent on the distance between the inner and outer mold subassemblies 102, 106 is generally the thickness of the barrier 300 being poured; thereby being dependent on the type of mold filling. For example, a concrete mold filling has a range of thicknesses may vary from ½" to 4".

Figure 5A:
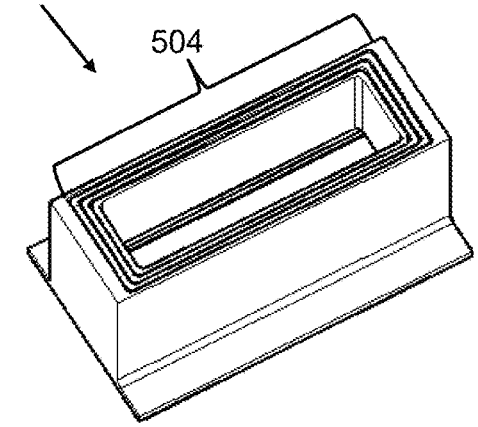
FIGS. 5A-5B illustrate perspective views of an exemplary linear barrier subsystem and an L-shaped barrier subsystem in a collapsed position, in accordance with an embodiment of the present invention.
Figure 5B:
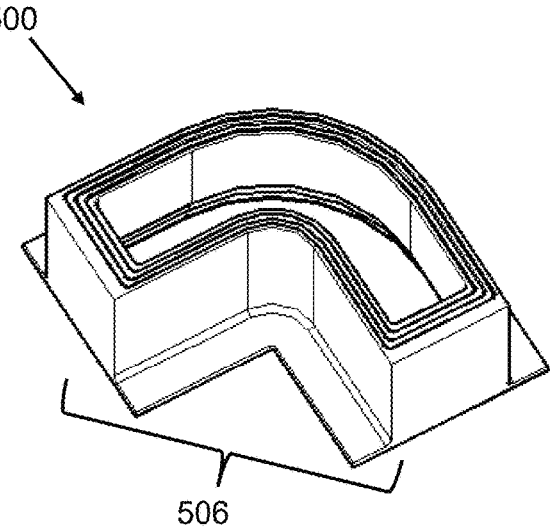

In one non-limiting embodiment, shown in FIG. 5A inner and outer mold subassemblies 500 are defined by a rectangular shape, with a hollow space that forms inside interior mold subassembly. This creates a rectangular shaped barrier subsystem 504. As illustrated, a collapsed position of barrier subsystem 504 is ready for deployment. However, mold subassemblies may also have other shapes, such as an L-shape, shown in FIG. 5B. L-shape mold subassembly creates a corresponding L-shaped barrier subsystem 506. In an alternative embodiment, barrier may be a solid monolithic piece with no hollow central space.

Figure 6A:
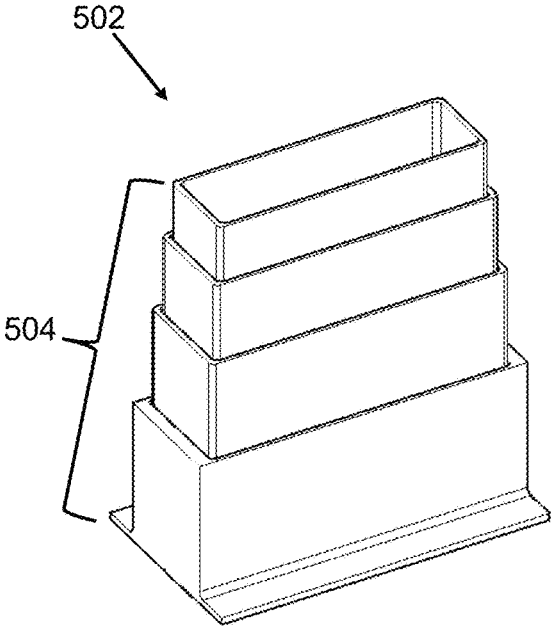
FIGS. 6A-6B illustrates a perspective view of an exemplary linear barrier subsystem and an L-shaped barrier subsystem in a deployed position, in accordance with an embodiment of the present invention.
Figure 6B:
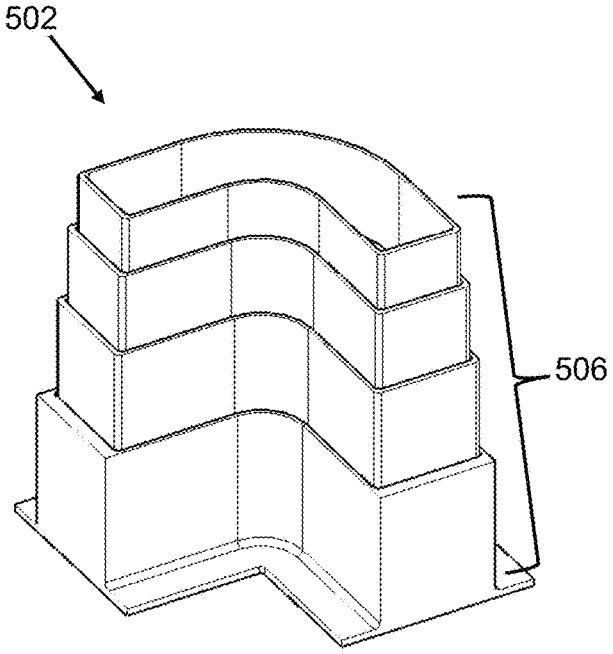

Furthermore, when a telescoping configuration of rectangular barrier subsystem 504 is extended to a deployed position 502, and the rectangular shape is retained (See FIG. 6A). And, as shown in FIG. 6B, the same applies to the L-shaped configuration of barrier subsystems 506 when retracted to a compacted deployed position 502. In any case, the mold subassemblies form the shape of a barrier, which can be used to restrict passage of water between barrier subsystems 504, 506.

To interconnect the panels 104*a-d*, 108*a-d*, the lateral edges engage in a flush manner. To accomplish this, panels are fabricated with a tapped hole 402, a tapped blind hole, or other hidden borehole used for fastening means. In one embodiment, a first tapped hole forms in linear panel, and aligns with a second tapped hole that forms in corner panel, allowing at least one fastening mechanism 404 to fasten the adjoining panels. As FIG. 4A illustrates, fastening mechanism 404 may be used to engage tapped hole 402 or tapped blind hole, whichever type is used. In some embodiments, fastening mechanism 404 may include, without limitation, a flat head screw, a hatch, and a snapping pin. However, panels 104*a-d*, 108*a-d* can be coupled together through other fastening mechanisms, including, without limitation, a latch. A screw, a pin, a snap-on connector, and a magnet. FIG. 4B illustrates yet another fastening mechanism. This is an elongated screw and nut 406 that passes longitudinally through panels, whether recessed or not.

Fastening mechanism 404 addresses problem of forming a flush panel surface with tight tolerances. Panels 104*a-d*, 108*a-d* are fabricated such that an inner fastening mechanism 404 connects the vertical and corner inner panels 104*a-d*. In one embodiment, inner fastening mechanism 404 orients away from the gap 110, and is defined by a flat surface, whereby the inner panels 104*a-d* facing the gap 110 are substantially even. Similarly, for outer panels 108*a-d*, at least one outer fastening mechanism 404 connects outer panels 108*a-d* together. Similarly, outer fastening mechanism 404 orients away from gap 110 between mold subassemblies 102, 106. In one non-limiting embodiment, outer fastening mechanism 404 is defined by a flat surface, whereby outer panels 108*a-d* are substantially even.

One construction problem addressed by fastening mechanism 404 and tapped hole 402 is that the mold subassemblies 102, 106 must be assembled and disassembled expeditiously. To address the problem, the connection between the panels must be such that each connection is with a flat head screw, hatch, or snapping pins that creates a secure and fast connection between the panels. Thus, inner and outer fastening mechanism 404*s* comprise flat head screws, hatches, snapping pins, tapped through holes and tapped blind holes. In other embodiments, the connection between two consecutive panels is comprised by a combination of screws, slotted holes, threaded holes, circular holes and latches that allows a temporal yet secure connection between two adjacent panels.

Figure 2:
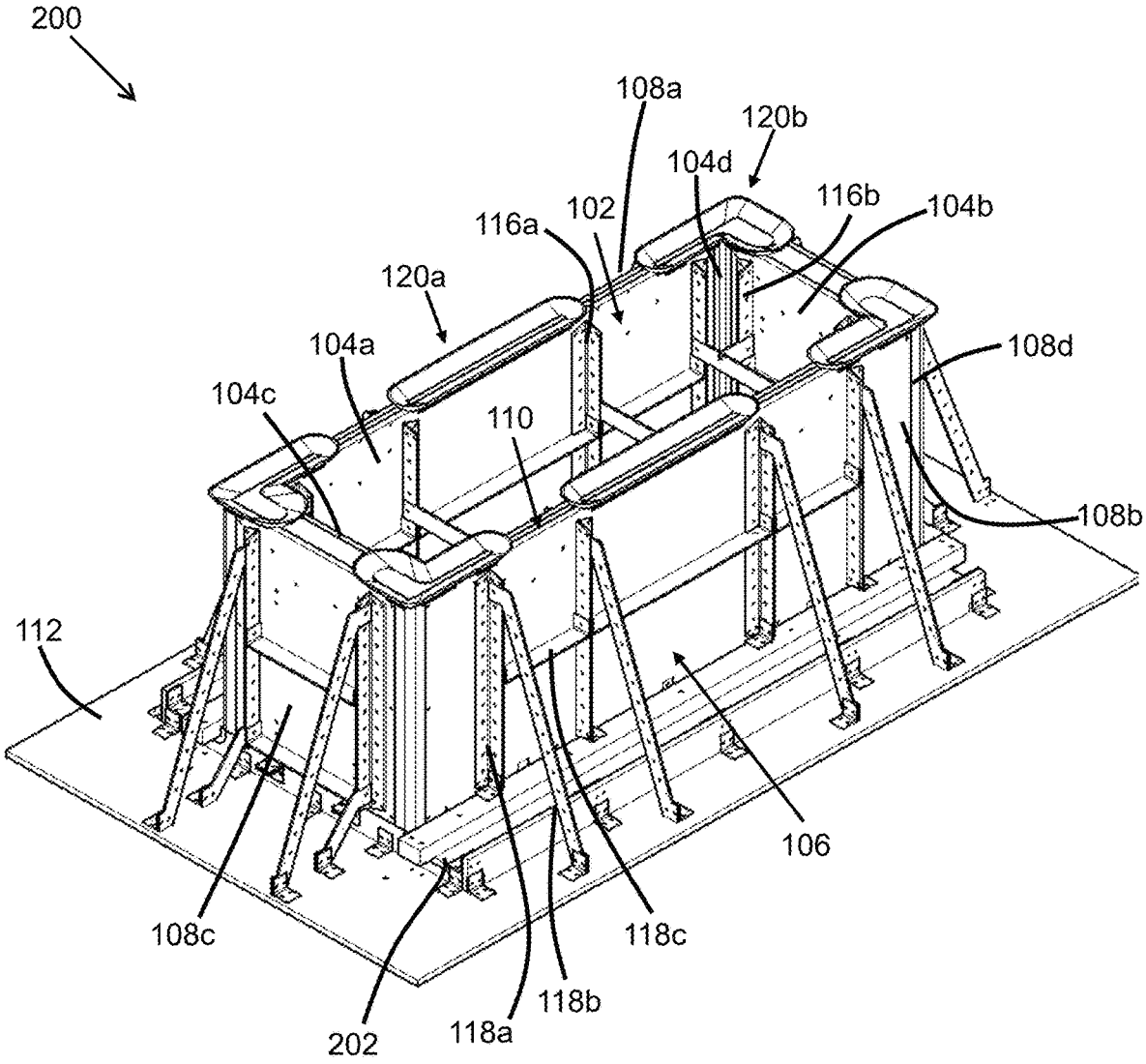
FIG. 2 illustrates a perspective view of an exemplary mold system for a modular telescoping barrier, showing a second embodiment of a mold subassembly with a foot mold for creating a support flange at the barrier, in accordance with an embodiment of the present invention.

Looking again at FIGS. 1 and 2, the system 100 provides a platform 112 that supports the inner and outer mold subassemblies 102, 106. Platform 112 engages lower edges of the panels. Platform 112 is useful by allowing formed barrier 300 to be carried once mold subassemblies 102, 106 are removed. In one embodiment, platform 112 is a metal, or rigid polymer that allows greater mobility for finished barriers.

One problem for construction of such barriers is that bulging occurs in the panels as the mold filling is being poured into the gap 110 between the mold subassemblies 102, 106. System 100 addresses the bulging problem is addressed with inner and outer reinforcing structure 118*a*, 118*b*, 118*cs* that are strong enough to avoid bulging of the panels outwardly, or inwardly.

To address bulging, stability, and vertical compliance, the system 100 provides at least one inner reinforcing structure 116*a*, 116*b* that abuts the inner panels 104*a-d* of inner mold subassembly 102. Inner reinforcing structure 116*a*, 116*b* minimizes deformation of the inner panels 104*a-d* when the cavity receives the mold filling. Inner reinforcing structure 116*a*, 116*b* helps maintain inner mold subassembly 102 in a substantially vertical orientation. Inner reinforcing structure 116*a*, 116*b* may include a steel beam or angle bar that is disposed horizontally, vertically, or diagonally across inner surface of inner panels 104*a-d*. However, in other embodiments, inner reinforcing structure 116*a*, 116*b* may include any structure that abuts inner panels 104*a-d* to prevent leaning from a vertical, or bulging by inner panels 104*a-d* from the effects of pouring the mold filling. This serves to create a tighter tolerance for the finished barrier 300.

As with the inner mold subassembly 102, at least one outer reinforcing structure 118*a*, 118*b*, 118*c* abuts the outer panels 108*a-d* of the outer mold subassembly 106. Outer reinforcing structure 118*a*, 118*b*, 118*c* serve to maintain outer mold subassembly 106 in a substantially vertical orientation while mold filling is poured in the gap 110. Outer reinforcing structure 118*a*, 118*b*, 118*c* may include a steel beam or an angle bar that is disposed horizontally, vertically, or diagonally across outer surface of outer panels 108*a-d*. However, in other embodiments, outer reinforcing structure 118*a*, 118*b*, 118*c* may include any structure that abuts the outer panels 108*a-d* to prevent leaning from a vertical, or bulging out by the outer panels 108*a-d* from the mold filling. This serves to create a tighter tolerance for the finished barrier 300.

In one non-limiting embodiment shown in FIG. 3, at least one L-bracket 308*a*, 308*b* rests at the bottom end of the reinforcing structure 118*a-c*. The L-bracket 308*a-b* serves to connect the reinforcing structure 18*a-c* to the platform 112. The L-bracket 308*a-b* clamps the panels down to form a tight closure at the lower edge of the panels.

Looking again at FIG. 3, at least one perimeter element 114*a-b* is used to reinforce the integrity of outer mold subassembly 106 by surrounding, and encasing a portion of the perimeter of outer mold subassembly 106 and inner mold subassembly 102, i.e., a ring. Perimeter element 114*a-b* serves to enhance stability of the mold subassemblies 102, 106 by restricting movement of the lower edges of panels while being filled with mold filling. In some embodiments, perimeter element 114*a-b* may include a ring-shaped steel bracket that follows the shape of outer mold subassembly 106. In other embodiments, perimeter element 114*a-b* may be integrated into platform 112. In one alternative embodiment, the perimeter element 114*a-b* can be broken down in to two sections 114*a*, 114*b*, as shown in FIG. 3. However, the perimeter element can also be broken down along a cross section. This may be useful when stacking multiple perimeter elements along the height of the outer mold subassembly 106.

In other embodiments, perimeter element 114*a-b* encompasses the outer mold subassembly 106 to reinforce the perimeter and prevent outward bulging when mold filling is poured into gap 110 between inner and outer mold subassemblies 102, 106. Perimeter element 114*a-b* may be size adjusted to accommodate variously sized mold subassemblies 102, 106. Or differently sized perimeter elements 114*a-b* can be used with a correspondingly sized inner and outer mold subassemblies 102, 106. In one possible embodiment, perimeter element 114*a-b* surrounds lower edge of outer panel, abutting platform 112. In an alternative embodiment, multiple perimeter elements 114*a-b* surround outer mold subassembly 106 in a tiered arrangement.

As discussed above, mold subassemblies 102, 106 form a size-specific mold for pouring a mold filling into the gap 110 between the inner and outer mold subassemblies 102, 106. As the mold filling occupies the entirety of the gap 110 between the inner and outer mold subassemblies 102, 106, it hardens and takes the shape of a barrier 300. In some embodiments, different sizes of mold subassemblies 102, 106 create incrementally larger or smaller barriers. This allows the barriers to be stacked in a telescoping, or nested, configuration. For example, as the length of panels decrease, the barriers formed have a lesser length and width. The shorter barriers are nested inside the larger barriers to create the telescoping arrangement of the barrier subsystem 900.

To produce a tight tolerance during pouring mold filling into the mold subassemblies 102, 106, a unique set of shape-adapted funnels 120*a*, 120*b* are utilized to discharge the mold filling into the gap 110 between the mold subassemblies 102, 106. Funnels 120*a-b* are uniquely configured to match the shape of the linear and corner panels, and then to mount to the top edges of the panels. In one non-limiting embodiment, a linear funnel 120*a* fits to a linear panel (See FIG. 7), while a corner funnel 120*b* (L-shaped) fits to a corresponding corner panel (See FIG. 8). Funnels 120*a-b* mount directly above the gap 110 between the inner and outer mold subassemblies 102, 106, so that mold filling discharges directly and efficiently into the gap 110.

Those skilled in the art will recognize that telescopic barriers must have the ability to be extended and retracted; and thus, must be as light as possible. This is achieved, in part, by constructing the barriers with thin walls. The problem with trying the construct thin elements 114*a-b* is the level of difficulty to try to get the material from the mixer to the gap 110 between the mold subassemblies 102, 106. To address the problem, slotted funnels 120*a*, 120*b* are used. Unlike conventional funnels 120*a*, 120*b*, slotted funnels 120*a*, 120*b* are not circular, but are adapted to fit the slotted shape of the gap 110 between the mold subassemblies 102, 106. Further, funnels 120*a*, 120*b* can be connected to create a line of funnels 120*a*, 120*b* that eases the process of pouring mold filling into the mold subassemblies 102, 106. Also, the funnels 120*a*, 120*b* are equipped with clamps that connect to the outer side of the inner and outer panels 108*a-d*. Clamps create a pinching effect that keeps the funnels 120*a*, 120*b* in place and prevents lateral expansion (bulging) of panels while mold filling material discharges from funnels 120*a*, 120*b*.

Figure 7:
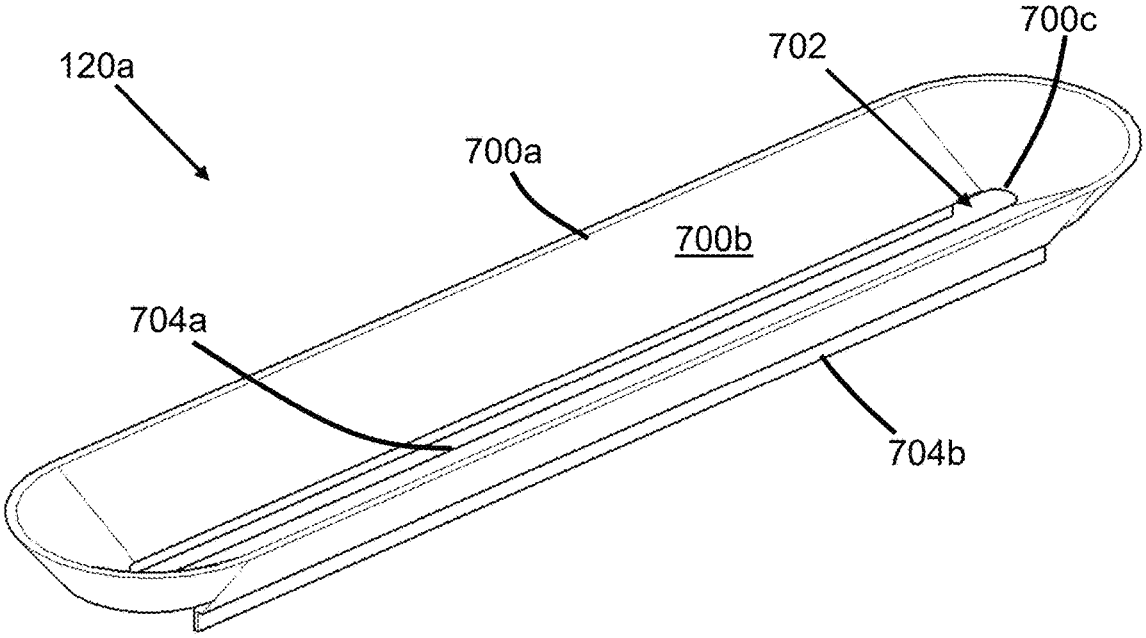
FIG. 7 illustrates a perspective views of an exemplary linear shape-adapted funnel, in accordance with an embodiment of the present invention.

Looking again at FIG. 7, a linear funnel 120*a* comprises an elongated wide receiving end 700*a*, a sloped sidewall 700*b*, and a narrow discharge end 700*c* terminating at a discharge opening 702. Wide receiving end 700*a* is configured to receive the mold filling. Sloped sidewalls 700*b* allow mold filling to easily slide down to narrow discharge end 700*c* for discharge over the gap 110. The discharge end of funnels 120*a*, 120*b* comprises a pair of clamps 704*a*, 704*b*. Clamps 704*a-b* extends along the longitudinal of discharge end of funnel 120*a*, 120*b*.

Figure 8:
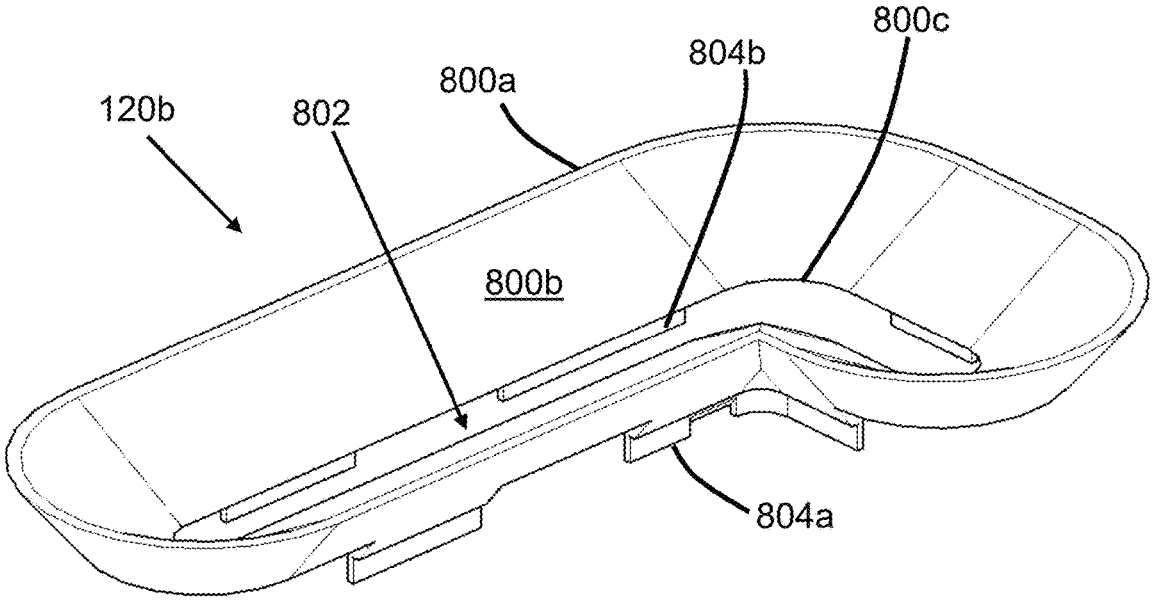
FIG. 8 illustrates a perspective views of an exemplary L-shaped funnel, in accordance with an embodiment of the present invention.

Clamps 704*a-b* are operable to bias the outer panels 108*a-d* inwardly towards the inner panels 104*a-d*, so as to minimize bulging outwardly, and also to maintain stability of panels while pouring mold filling into gap 110. FIG. 8 shows a similarly configured corner funnel 120*b* with an L-shaped wide receiving end 800*a*, a sloped sidewall 800*b*, and a narrow discharge end 800*c* terminating at a discharge opening 802. Corner funnel 120*b* also utilizes a pair of clamps 804*a*, 804*b* to bias the corner panels 104*d*, 108*d* inwardly, and avoid bulging therein.

After being poured into gap 110, the mold filling hardens to take the shape of the barrier 300. Thus, mold filling is poured in gap 110 between inner and outer mold subassemblies 102, 106, and hardens to form barrier 300. This forms the barrier 300. As FIGS. 5A-5B reference, a barrier 300 is nested with multiple other barriers having incrementally different sizes to create a barrier subsystem 900. Incrementally larger or smaller sized inner and outer mold subassemblies 102, 106 are utilized to form a series of barriers having incrementally different perimeter dimensions. As illustrated the barriers form a series of barriers of progressively smaller diameters nested within each other.

This incremental difference in perimeter size is what creates the telescoping effect. In one example, a first barrier 300 is formed having a large perimeter. A subsequent barrier 300 is formed having a smaller perimeter. The barrier 300 with the smaller perimeter nests inside the barrier 300 with the larger perimeter. When the mold filling is poured in the gap 110 between the inner and outer mold subassemblies 102, 106, the multiple barriers forming a barrier subsystem 900.

Looking back to FIG. 2, a base barrier 902 can be formed from a base version mold subassembly 200, in which a foot mold 202 is integrated therein. Base barrier 902 serves as a larger, more stable foundation for the telescoping arrangement of multi-sized barriers 906*a*, 906*b*, 906*c* nested and telescoping thereon. Base barrier 902 is formed from the mold filling occupying the mold subassembly 200; yet in a slightly different configuration than the mold subassemblies 102, 106 used in barrier 300 described above.

For base barrier 902, the lower edge of outer panel in outer mold subassembly 200 comprises a foot mold 202. Foot mold 202 is in fluid communication with the gap in base version mold subassembly 200. Consequently, a base barrier 902 with a support flange 904 forms when the mold filling is poured in gap 110 and foot mold 202. After mold filling dries, outer mold subassembly 106 and foot mold 202 are removed to reveal base barrier 902 and support flange 904.

Figure 9:
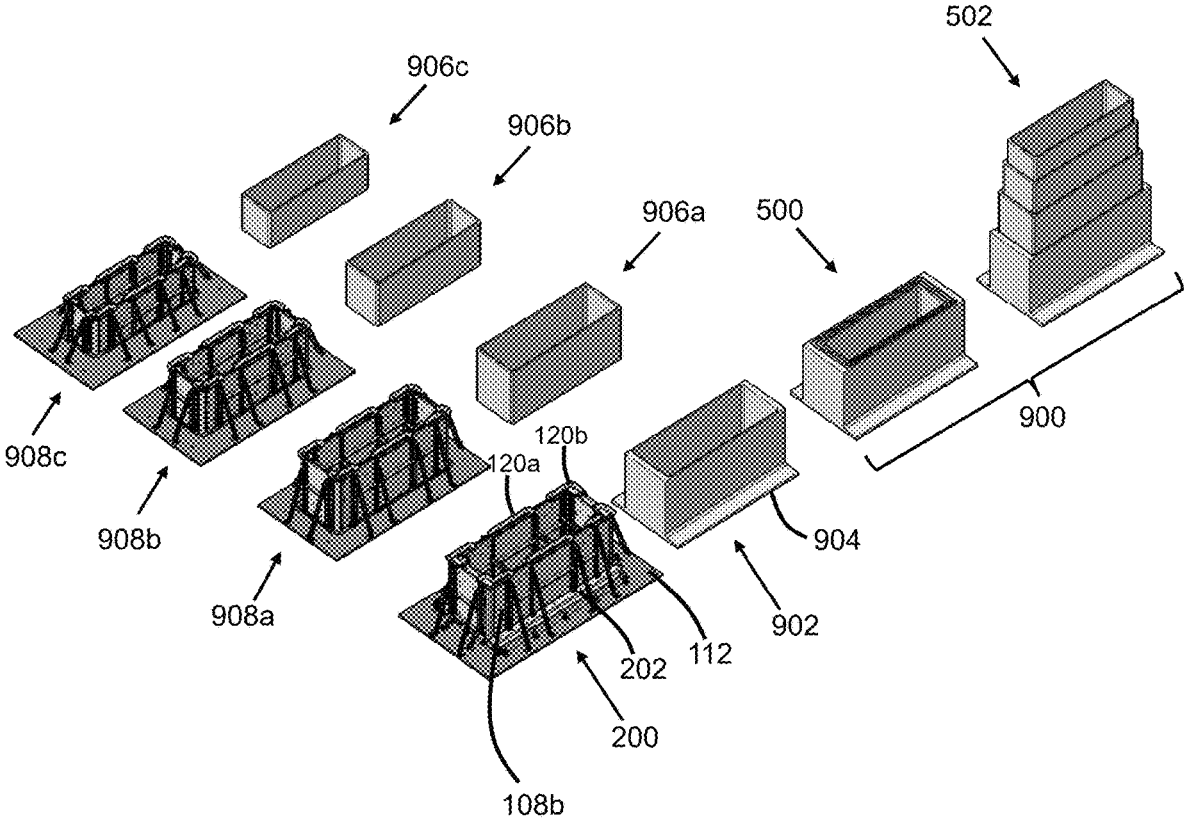
FIG. 9 illustrates a perspective views of a barrier subsystem, showing the base barrier and multiple different sized barriers with corresponding mount subassemblies, in accordance with an embodiment of the present invention.

Turning now to FIG. 9, base barrier 902 is constructed monolithically with a flat support flange 904. Further, base barrier 902 has a larger perimeter than the multiple barriers 906*a*, 906*b*, 906*c* that are sized with the different perimeter dimensions from their corresponding mold subassemblies 908*a*, 908*b*, 908*c*. As illustrated the barriers 906*a-c* form a series of barriers of progressively smaller diameters nested within each other. Base barrier 902 is the largest barrier, supporting other barriers 906*a-c*. Support flange 904 from base barrier 902 is used to evenly support the weight of barriers 906*a-c*.

In one non-limiting embodiment, support flange 904 is orthogonal to base barrier 902. This allows support flange 904 to create greater stability for the smaller, nested barriers contained in the base subsystem 900, as more surface area is covered. This additional stability at the lowest level base barrier 902 is necessary since the other barriers 906*a*, 906*b*, 906*c* are arranged in a telescopic, or nested, configuration squarely on the base barrier 902. Support flange 904 increases surface area with platform 112, which adds stability to mold subassembly while mold filling is being poured in gap 110 therebetween.

Figure 10:
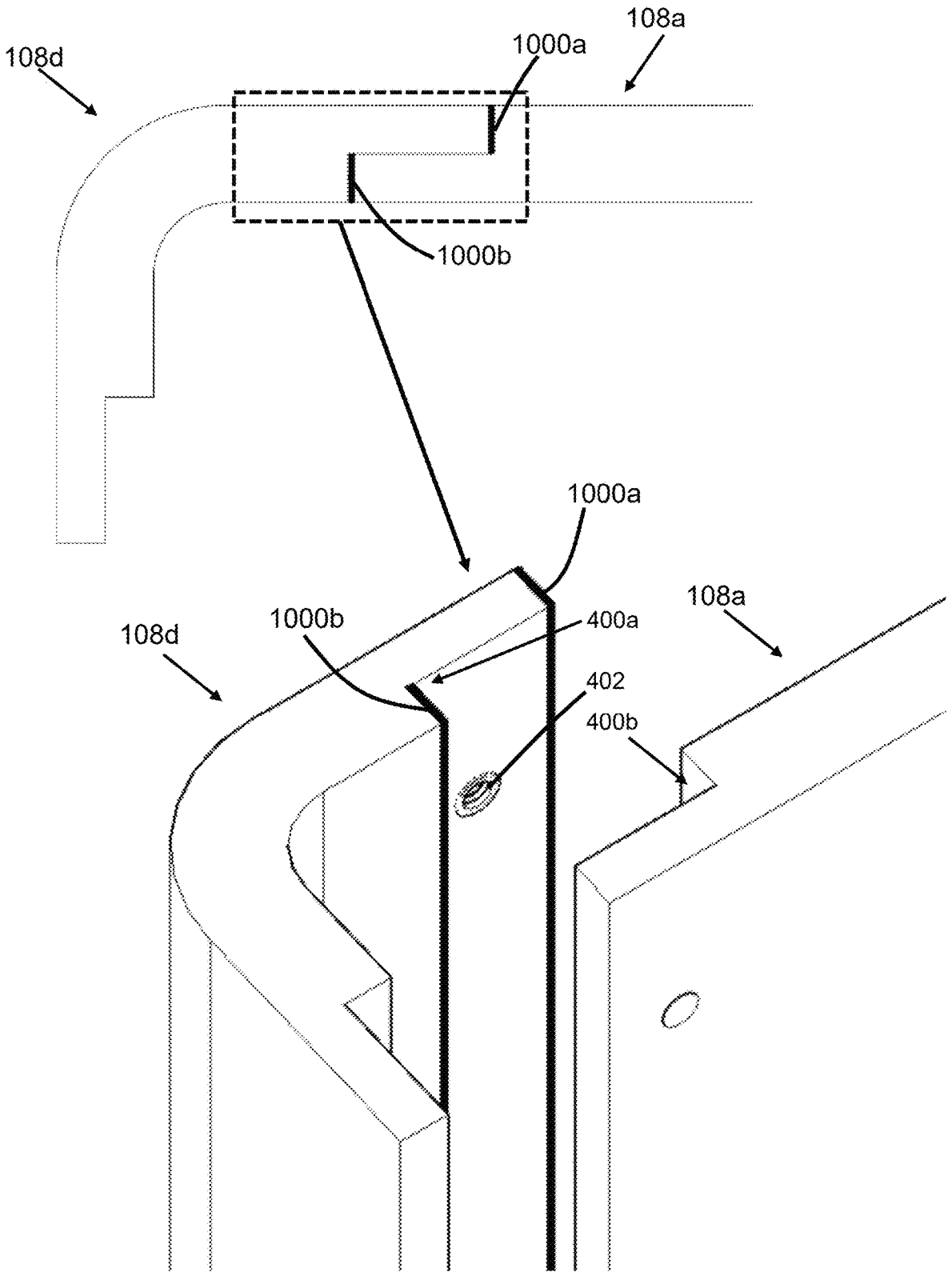
FIG. 10 illustrates a close-up view of an exemplary elastic member disposed at the lateral edges of a linear panel and corner panel, in accordance with an embodiment of the present invention.

Looking now at FIG. 10, the lateral edges of both inner and outer panels 108*a-d* comprise an elastic member 1000*a*, 1000*b*. Elastic member 1000*a-b* may include a rubber strip, silicon strip, or other resilient material used for waterproofing. Elastic member 1000*a-b* is configured to restrict passage of mold filling between the interconnected panels. It is significant to note that use of elastic member 1000*a-b* is dependent on the type of material used for mold filling. For example, a cement mold filling may not require elastic member 1000*a-b* to prevent leakage of mold filling; while a more viscous mold filling would require the use of elastic member 1000*a-b* to prevent leakage from between panels.

To enhance the stability of the inner and outer mold subassemblies 102, 106 while the mold filling is being poured therebetween, the system 100 provides at least one level 304 that is operable on the outer reinforcing structure 118*a*, 118*b*, 118*c*, or the platform 112. Level 304 is effective for enhancing flowage of mold filling into gap 110 between mold subassemblies 102, 106 in a substantially horizontally orientation. This helps achieve the geometry needed by the barriers. Thus, molds are equipped with at least one level 304, including a spirit level primarily, at each corner panel so the overall level needed of the mold subassemblies 102, 106 can be achieved. Level indicates the horizontal disposition of the panels. The horizontally even panels are disposed such that, a more uniform distribution of the mold filling into the gap 110 occurs. This allows for more precise construction of barriers.

Another tool used to create uniform distribution of the mold filling in the mold subassemblies 102, 106, at least one agitating mechanism 306 is operable on the outer reinforcing structure 118*a*, 118*b*, 118*c*, or in an area surrounded by the inner panels 104*a-d*. To help create adequate flowage of mold filling into the gap 110 inside the molds, the panels can be vibrated externally, such that the mold filling fills the mold subassemblies 102, 106 and reach all the details needed from the final design of barrier 300. To address this problem, the mold subassemblies 102, 106 are equipped with agitating mechanism 306, or vibrators, that can be attached to the side panels and/or located at the base of the mold subassemblies 102, 106. By vibrating the panels with agitating mechanism 306, a more uniform distribution of the mold filling into the gap 110 is possible.

As discussed above, after the mold filling has solidified inside the gap 110 between the inner and outer mold subassemblies 102, 106, multiple hollow barriers form. The barriers combine in a telescoping relationship. In one embodiment, multiple hollow barriers telescopically extend to a deployed position to form a barrier subsystem 900 that withstands inertial and the external forces (FIG. 6A). Conversely, barriers can be retracted to a collapsed position (FIG. 5A). In one possible embodiment, multiple hollow barriers of incrementally different sizes are arranged in a nested configuration, such that each barrier 300 slides along a sliding mechanism in and out of an adjacent barrier 300.

Such a telescopic structural configuration allows the hollow barriers to be stored inside of each other and to extend when the use of the structural element 114*a-b* is required. One exemplary use of such telescoping barriers that requires very small tolerance on the overall dimensions of the structural elements 114*a-b* is when system 100 is utilized as a flood control structure. The ability to acquire the exact specified gap 110 between the hollow barriers stored inside of each other is crucial for the correct operation of the mechanisms that provide the water seepage control.

Barriers are configured to telescopically slide in a manner taught in U.S. Pat. No. 9,739,048, titled "Telescopic Structural Systems and Construction Method". Thus, in one exemplary embodiment of telescoping action between barriers, a nested configuration of interlocking barriers is coupled together, so as to slide vertically with respect to the other. Base barrier 902 forms a foundation and a plurality of deployable barriers are arranged in a nested configuration. Each barrier 300 is configured to slide in and out of an adjacent barrier 300. A lifting mechanism applies an axial force to the deployable barriers to move between the operational and collapsed position.

In one exemplary lifting mechanism, the system provides a pair of spring biased lateral support members that are operational on each deployable barrier 300. The spring biased lateral support members are disposed opposite each other in alignment on the inner surface of each deployable barrier 300. The spring biased lateral support members comprise a spring and a spring conduit.

As each deployable barrier 300 extends to the deployed position, the spring is biased to expand from the inner surface of the deployable sidewall. Conversely, as each deployable barrier 300 retracts to the collapsed position, the spring is compressed by an outer deployable barrier 300 towards the inner surface of the deployable sidewall. It is also significant to note that each deployable barrier 300 has a unique cable and pulley that operatively connect to the spring biased lateral support member of each deployable barrier 300. In this manner, the deployable barriers extend and retract incrementally. The pulley may include a series of pulleys arranged in a parallel disposition and extending between the deployable barriers of the innermost deployable barrier 300. The cable may include a cable that is operational for each deployable barrier 300. Guide rails may also be used at the edges of the mold subassemblies to guide the barriers in a vertical direction.

Figure 11:
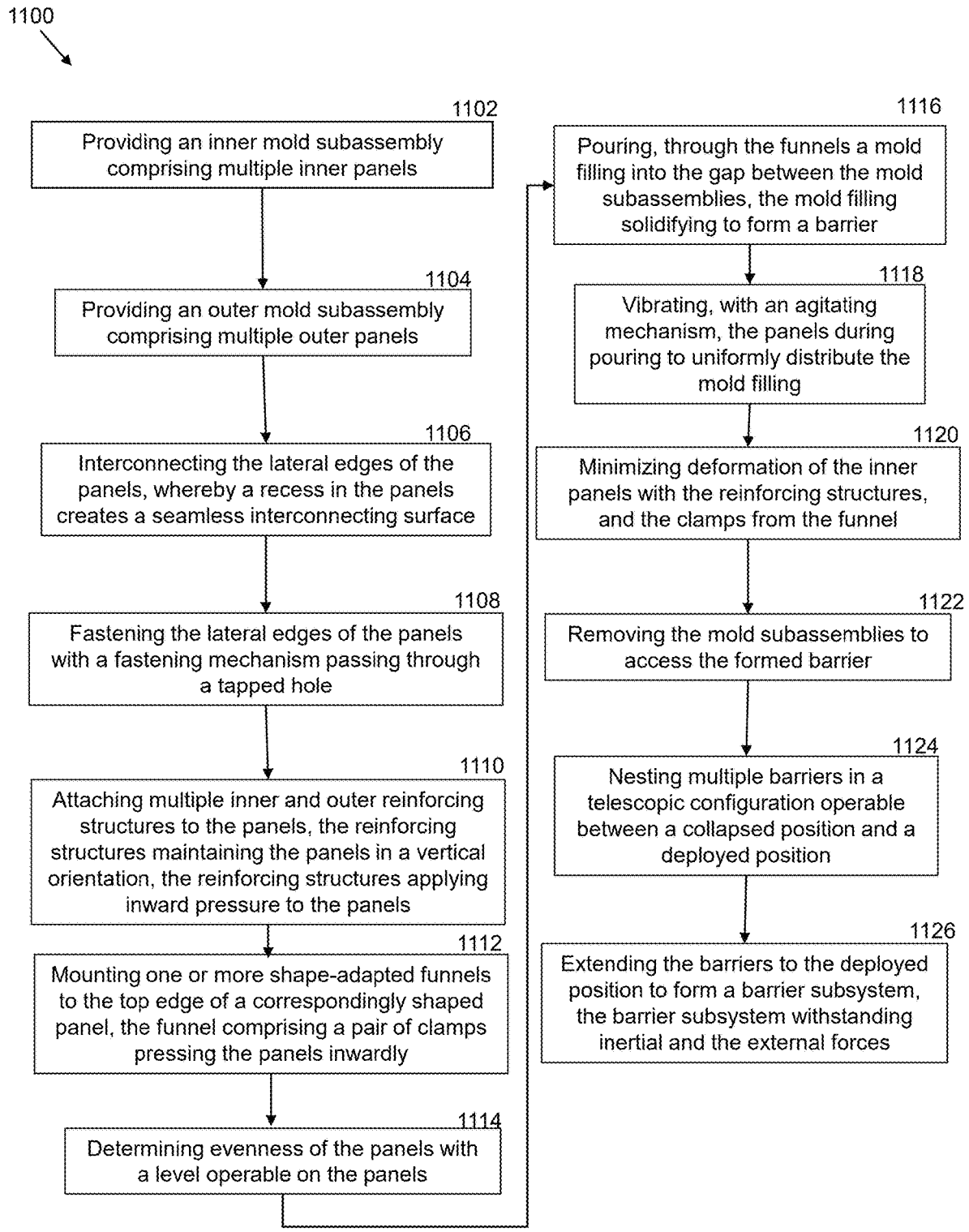
FIG. 11 illustrates a flowchart of an exemplary method for constructing a modular telescoping barrier system, in accordance with an embodiment of the present invention.

FIG. 11 illustrates a flowchart of an exemplary method 1100 of constructing a modular telescoping barrier system. Method 1100 may include an initial Step 1102 of providing an inner mold subassembly comprising multiple inner panels. Method 1100 may further comprise a Step 1104 of providing an outer mold subassembly comprising multiple outer panels, a gap forming between the mold subassemblies. A Step 1106 includes interconnecting the lateral edges of the panels, whereby a recess in the panels creates a seamless interconnecting surface. Individual panels 104*a-d*, 108*a-d* comprise a pair of lateral edges 302*a*, 302*b*, an upper edge 302*c*, and an opposing lower edge 302*d*. Inner panels 104*a-d* fit together and securely fasten at the lateral edges. As FIG. 4A references, inner panels 104*a-d* interconnect in a seamless relationship, partially due to a recess 400*a*, 400*b* that forms between at least one of the lateral edges.

In some embodiments, a Step 1108 comprises fastening the lateral edges of the panels with a fastening mechanism passing through a tapped hole. In one embodiment, a first tapped hole forms in linear panel, and aligns with a second tapped hole that forms in corner panel, allowing at least one fastening mechanism 404 to fasten the adjoining panels. A Step 1110 includes attaching multiple inner and outer reinforcing structures to the panels, the reinforcing structures maintaining the panels in a vertical orientation, the reinforcing structures applying inward pressure to the panels. In some embodiments, a Step 1112 may include mounting one or more shape-adapted funnels to the top edge of a correspondingly shaped panel, the funnels comprising a pair of clamps pressing the panels inwardly.

A Step 1114*a-b* comprises determining evenness of the panels with a level operable on the panels. Method 1100 may further comprise a Step 1116 of pouring, through the funnels a mold filling into the gap between the mold subassemblies, the mold filling solidifying to form a barrier. A Step 1118 includes vibrating, with an agitating mechanism, the panels during pouring to uniformly distribute the mold filling. In some embodiments, a Step 1120 comprises minimizing deformation of the inner panels with the reinforcing structures, and the clamps from the funnel. A Step 1122 includes removing the mold subassemblies to access the formed barrier. In some embodiments, a Step 1124 may include nesting multiple barriers in a telescopic configuration operable between a collapsed position and a deployed position. A final Step 1126 includes extending the barriers to the deployed position to form a barrier subsystem, the barrier subsystem withstanding inertial and the external forces.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A mold system modular telescoping barrier, the system comprising:

an inner mold subassembly comprising multiple inner panels defined by a pair of lateral edges, an upper edge, and a lower edge, the inner panels joined at the lateral edges;

at least one inner reinforcing structure abutting the inner panels of the inner mold subassembly, the inner reinforcing structure maintaining the inner mold subassembly in a substantially vertical orientation;

an outer mold subassembly comprising multiple outer panels defined by a pair of lateral edges, an upper edge, and a lower edge, the outer panels joined at the lateral edges, one of the pair of lateral edges defined by a recess, the outer mold subassembly disposed to surround the inner mold subassembly in a spaced-apart relationship, whereby a gap forms between the mold subassemblies;

at least one outer reinforcing structure abutting the outer panels of the outer mold subassembly, the outer reinforcing structure maintaining the outer mold subassembly in a substantially vertical orientation; and multiple funnels operable at the top edges of the panels, the funnels comprising a wide receiving end, a sloped sidewall, and a narrow discharge end forming a slot, the discharge end of the funnels comprising a clamp, the clamp being operable to press the inner and outer panels towards each other.

2. The system of claim 1, wherein the outer mold subassembly has a larger perimeter than the inner mold subassembly.

3. The system of claim 1, wherein the inner and outer panels comprise at least one elongated panel defined by a linear shape, and at least one corner panel defined by an L-shape.

4. The system of claim 1, wherein at least one of the pair of lateral edges is defined by a recess.

5. The system of claim 1, wherein the lateral edges of the panels are defined by a tapped hole, or a tapped blind hole, or both.

6. The system of claim 5, further comprising at least one fastening mechanism operable to pass through the tapped hole and the tapped blind hole.

7. The system of claim 1, wherein the funnels are operable to pour a mold filling in the gap between the inner and outer mold subassemblies.

8. The system of claim 7, wherein a barrier forms when the mold filling is poured in the gap between the inner and outer mold subassemblies.

9. The system of claim 8, wherein differently sized and dimensioned inner and outer mold subassemblies form multiple barriers having different perimeter dimensions, the multiple barriers having different perimeter dimensions forming a barrier subsystem.

10. The system of claim 9, wherein the lower edge of the outer panel comprises a foot mold, the foot mold being in fluid communication with the gap between the inner and outer mold subassemblies.

11. The system of claim 10, wherein a base barrier with a support flange forms when the mold filling is poured in the gap and the foot mold.

12. The system of claim 11, wherein the base barrier has a larger perimeter than the multiple barriers having different perimeter dimensions.

13. The system of claim 7, the edges of the panels comprise an elastic member, the elastic member operable to restrict passage of the mold filling between the panels.

14. The system of claim 1, further comprising a platform supporting the inner and outer mold subassemblies, the platform engaging the lower edges of the panels.

15. The system of claim 14, further comprising at least one level operable on the outer reinforcing structure, or the platform, or both.

16. The system of claim 1, further comprising at least one agitating mechanism operable on the outer reinforcing structure, or in an area surrounded by the inner panels, or both.

17. The system of claim 1, further comprising a perimeter element, the perimeter element encasing a portion of perimeter of the outer mold subassembly.

18. A mold system modular telescoping barrier, the system comprising:

an inner mold subassembly comprising multiple inner panels defined by a pair of lateral edges, an upper edge, and a lower edge, the inner panels joined at the lateral edges, at least one of the pair of lateral edges defined by a recess, the lateral edges further being defined by a tapped hole, or a tapped blind hole, or both;

at least one inner reinforcing structure abutting the inner panels of the inner mold subassembly, the inner reinforcing structure maintaining the inner mold subassembly in a substantially vertical orientation;

an outer mold subassembly comprising multiple outer panels defined by a pair of lateral edges, an upper edge, and a lower edge, the outer panels joined at the lateral edges, at least one of the pair of lateral edges defined by a recess, the lateral edges of the outer panels being defined by a tapped hole, or a tapped blind hole, or both, the outer mold subassembly disposed to surround the inner mold subassembly in a spaced-apart relationship, whereby a gap forms between the mold subassemblies;

at least one fastening mechanism operable to pass through the tapped hole and the tapped blind hole;

at least one outer reinforcing structure abutting the outer panels of the outer mold subassembly, the outer reinforcing structure maintaining the outer mold subassembly in a substantially vertical orientation;

a platform supporting the inner and outer mold subassemblies, the platform engaging the lower edges of the panels;

at least one L-bracket fastening the outer reinforcing structure to the platform;

multiple funnels operable at the top edges of the panels, the funnels comprising a wide receiving end, a sloped sidewall, and a narrow discharge end forming a slot, the discharge end of the funnels comprising a clamp, the clamp operable to press the inner and outer panels towards each other, the funnels being operable to pour a mold filling in the gap between the inner and outer mold subassemblies, whereby a barrier forms when the mold filling is poured in the gap between the inner and outer mold subassemblies;

at least one level operable on the outer reinforcing structure, or the platform, or both;

at least one agitating mechanism operable on the outer reinforcing structure, or in an area surrounded by the inner panels, or both; and a perimeter element, the perimeter element encasing a portion of perimeter of the outer mold subassembly.

19. The system of claim 18, wherein the lower edge of the outer panel comprises a foot mold, the foot mold being in fluid communication with the gap between the inner and outer mold subassemblies, whereby a base barrier with a support flange forms when the mold filling is poured in the gap and the foot mold.

20. A method of constructing a modular telescoping barrier system, the method comprising:

providing an inner mold subassembly comprising multiple inner panels;

providing an outer mold subassembly comprising multiple outer panels, a gap forming between the mold subassemblies;

interconnecting the lateral edges of the panels, whereby a recess in the panels creates a seamless interconnecting surface;

fastening the lateral edges of the panels with a fastening mechanism passing through a tapped hole;

attaching multiple inner and outer reinforcing structures to the panels, the reinforcing structures maintaining the panels in a vertical orientation, the reinforcing structures applying inward pressure to the panels;

mounting one or more shape-adapted funnel to the top edge of a correspondingly shaped panel, the funnel comprising a pair of clamps pressing the panels inwardly;

determining evenness of the panels with a level operable on the panels;

pouring, through the funnels a mold filling into the gap between the mold subassemblies, the mold filling solidifying to form a barrier;

vibrating, with an agitating mechanism, the panels during pouring to uniformly distribute the mold filling;

minimizing deformation of the inner panels with the reinforcing structures, and the clamps from the funnel;

removing the mold subassemblies to access the formed barrier;

nesting multiple barriers in a telescopic configuration operable between a collapsed position and a deployed position; and extending the barriers to the deployed position to form a barrier subsystem, the barrier subsystem withstanding inertial and the external forces.

* * * * *